US007341472B2

(12) United States Patent
Chao et al.

(10) Patent No.: US 7,341,472 B2
(45) Date of Patent: Mar. 11, 2008

(54) PLUG CONNECTOR WITH LATCH MEANS

(75) Inventors: Hsin-Min Chao, Tu-Cheng (TW); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/453,818

(22) Filed: Jun. 16, 2006

(65) Prior Publication Data

US 2007/0293079 A1 Dec. 20, 2007

(51) Int. Cl.
*H01R 13/627* (2006.01)

(52) U.S. Cl. ..... 439/358

(58) Field of Classification Search ..... 439/358, 439/352, 350, 353, 357, 607, 610
See application file for complete search history.

(56) References Cited

U.S. PATENT DOCUMENTS 6,558,183 B1 5/2003 Ji et al.
6,799,986 B2 * 10/2004 Igarashi et al. ..... 439/358
6,953,361 B2 * 10/2005 Li et al. ..... 439/358
6,957,976 B2 * 10/2005 Zhang ..... 439/358

* cited by examiner

*Primary Examiner*—Alexander Gilman
(74) *Attorney, Agent, or Firm*—Birch, Stewart, Kolasch & Birch, LLP

(57) ABSTRACT

A plug connector with latch means includes a casing, a mating portion and a latch means. The latch means consists of a lock member and a press member. The lock member has a lock arm, the front end of the lock arm projects sideward and defines a pawl, the back end projects sideward and defines a projection. The front end of the press member bends inward to define a press portion, the back end bends inward to define a blocking portion. To disengage the plug connector from the mating connector, the casing is pulled, the press member is driven to move backward along with the casing and the press portion presses the projection of the lock member, the projection is driven to move inward and drives the pawl move into the inlay cavity, thereby, the plug connector with latch means disengages from the mating connector easily.

9 Claims, 7 Drawing Sheets

PLUG CONNECTOR WITH LATCH MEANS

BACKGROUND OF THE INVENTION

1. Field of the Invention

The present invention relates to a plug connector, and more particularly to a plug connector with latch means.

2. The Related Art

In electronic devices, a plug connector is required to connect one electronic device with another electronic device. The plug connector is inserted into a mating connector. The plug connector is tending to release from the mating connector by an accident drag. As a result, the electrical connection between the plug connector and the mating connector is unstable. In order to increase the stability of the connection, different latch means are arranged in many matches of the plug connectors and the mating connectors.

U.S. Pat. No. 6,558,183 issued May 6, 2003 describes a plug connector having a casing, a mating portion and a latch means. The latch means includes a pair of lock members and a pair of release buttons. Each lock member includes a resilient lock arm, a pawl is formed on one end of each lock arm and a fixing foot is formed on the other end of each lock arm. The lock members are disposed at the two sides of the plug connector respectively and the release buttons are disposed at the outer sides of the lock members respectively. To disengage the plug connector from the mating connector, the release buttons are inwardly depressed and deflect the lock arms thereby the pawls are depressed and the plug connector releases from the mating connector. Then the release buttons are pressed and at the same time the plug connector is pulled out, thereby the plug connector disengages from the mating connector.

However, when the plug connector disengages from the mating connector, the plug connector is pulled out and the release buttons are pressed at the same time, so the operation is complicated and inconvenient. Moreover, when the plug connector is pulled out unintentionally without pressing the release buttons, the interior of the mating connector is scratched, resulting in damage to the mating connector.

SUMMARY OF THE INVENTION

Accordingly, an object of the present invention is to provide a plug connector with latch means including a casing, a mating portion and latch means. The casing has two sidewalls, a receiving cavity is defined in each sidewall. The mating portion has an insulated housing and a plurality of contacts received in the mating portion. An inlay cavity is defined in each of two sides of the insulated housing, the back end of the inlay cavity communicates with outside, the mating portion is received in the casing with the front portion of the mating portion projecting from the casing. The latch means includes a lock member and a press member received in the casing. The lock member has a bottom board, the bottom board extends forward to form a lock arm, the front end of the lock arm projects sideward to define a pawl, the back end projects sideward to define a projection, the lock arm is inserted into the inlay cavity of the mating portion with the pawl projecting from the inlay cavity. The press member includes a connecting arm, the front end of the connecting arm forms a press portion for pressing the projection of the lock member and the press member is received in the receiving cavity.

To disengage the plug connector from the mating connector, the casing is pulled, the press member positioned in the casing moves backward along with the casing, the press portion presses the projection of the lock member and drives the projection move inward, as a result, the pawl is driven to move into the inlay cavity and loses the cooperation with the mating connector, thereby, the plug connector with latch means disengages from the mating connector easily.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
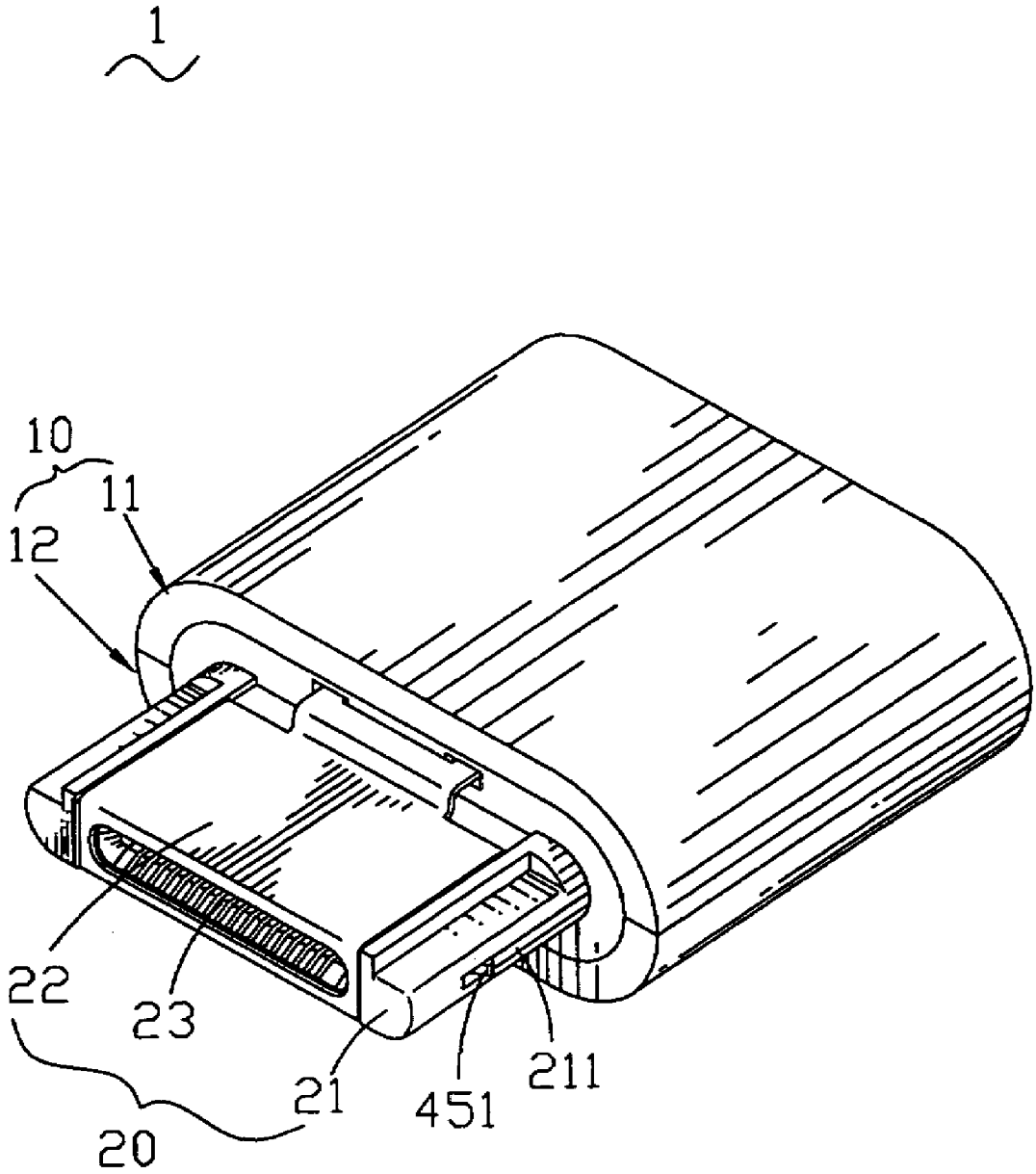
FIG. 1 is a perspective view of a first embodiment of a plug connector with latch means according to the present invention.

For facilitating understanding, like components are designated by like reference numerals throughout the various embodiments of the invention as shown in the attached drawings.

Figure 2:
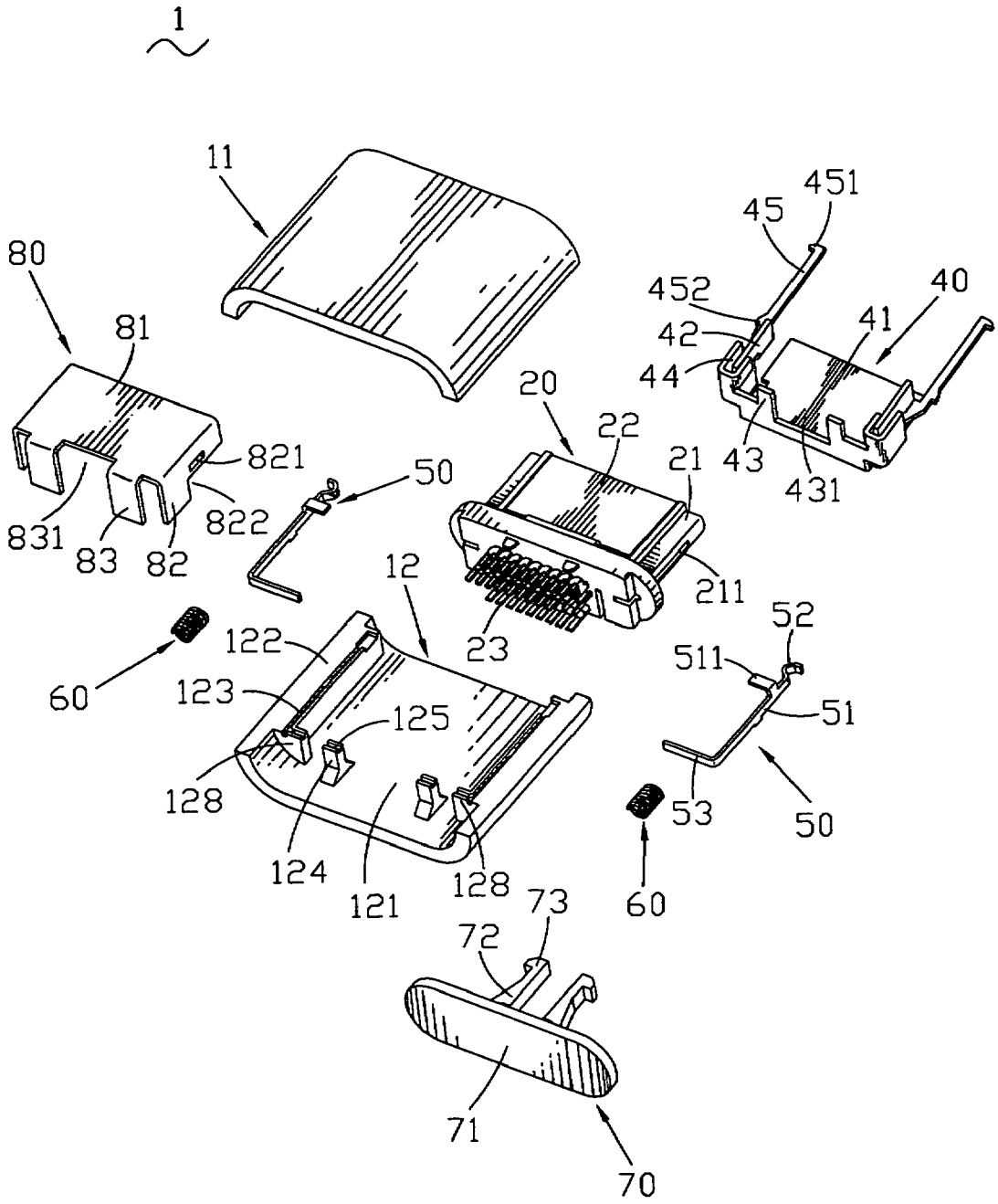
FIG. 2 is an exploded view of the plug connector with latch means shown in FIG. 1.

First referring to FIGS. 1-2, a first embodiment of a plug connector with latch means 1 according to the present invention including a casing 10, a mating portion 20, latch means and a shield 80.

The casing 10 includes an upper case 11, a lower case 12 engages with the upper case 11 and a receiving space is formed there-between. The lower case 12 has a bottom wall 121, two opposite sides of the bottom wall 121 extend upward and define two sidewalls 122. Each sidewall 122 defines a receiving cavity 123, an opening is defined at the front end of the receiving cavity 123 and pass through the receiving space. A blocking cavity 128 is defined transversely at the back end and pass through the receiving space. A receiving projection 124 is mounted on the bottom wall 121 and corresponding to the blocking cavity 128. A holding cavity 125 is defined in the receiving projection 124 and keep in one line with the blocking cavity 128.

The mating portion 20 includes an insulated housing 21, a metal piece 22 disposed at the front of the insulated housing 21 and a plurality of contacts are received in the insulated housing 21. An inlay cavity 211 is defined in each of two sides of the insulated housing 21, the back end of the inlay cavity 211 communicates with outside.

The latch means includes a lock member 40, a press member 50, a pair of springs 60 and a receiving member 70. The lock member 40 includes a bottom board 41, two opposite sides of the bottom board 41 extend upward and define two side boards 42, the back of the bottom board 41 extends upward and defines a back board 43. The foot of the side board 42 extends forward and forms a lock arm 45. The front end of the lock arm 45 projects sideward and defines a pawl 451, the back end projects sideward and defines a projection 452 having an inclined side surface. A notch 431 is defined in the center of the back board 43, two sides of the back board 43 extend outward and then bend forward to define two retaining cavities 44 paralleled to the side board 42.

The press member 50 includes a connecting arm 51, the front end of the connecting arm 51 bends inward and forms an arched press portion 52, the back end bends inward and is perpendicular to the connecting arm 51 to define a blocking portion 53. The middle of the connecting arm 51 extends inward and forms a restricting piece 511. The press member 50 is received in the receiving cavity 123 of the lower case 12, the arc of the press portion 52 faces the interior of the plug connector 1, the blocking portion 53 is received in the blocking cavity 128 and the holding cavity 125. The receiving member 70 includes a receiving board 71, a pair of holding arm 72 mounted on the receiving board 71, the front end of the holding arm 72 projects sideward and defines a retaining projection 73.

The shield 80 includes a top plate 81, the back of the top plate 81 extends downward to define a back plate 83 with a mating notch 831 in the center, two opposite sides of the top plate 81 extend downward to define two side plates 82, each side plate 82 has a restricting hole 821, an opening 822 is defined below the restricting hole 821.

Please refer to FIGS. 1-4, the assemblage of the plug connector with latch means 1 of the present invention is described hereinafter in detail.

Figure 3:
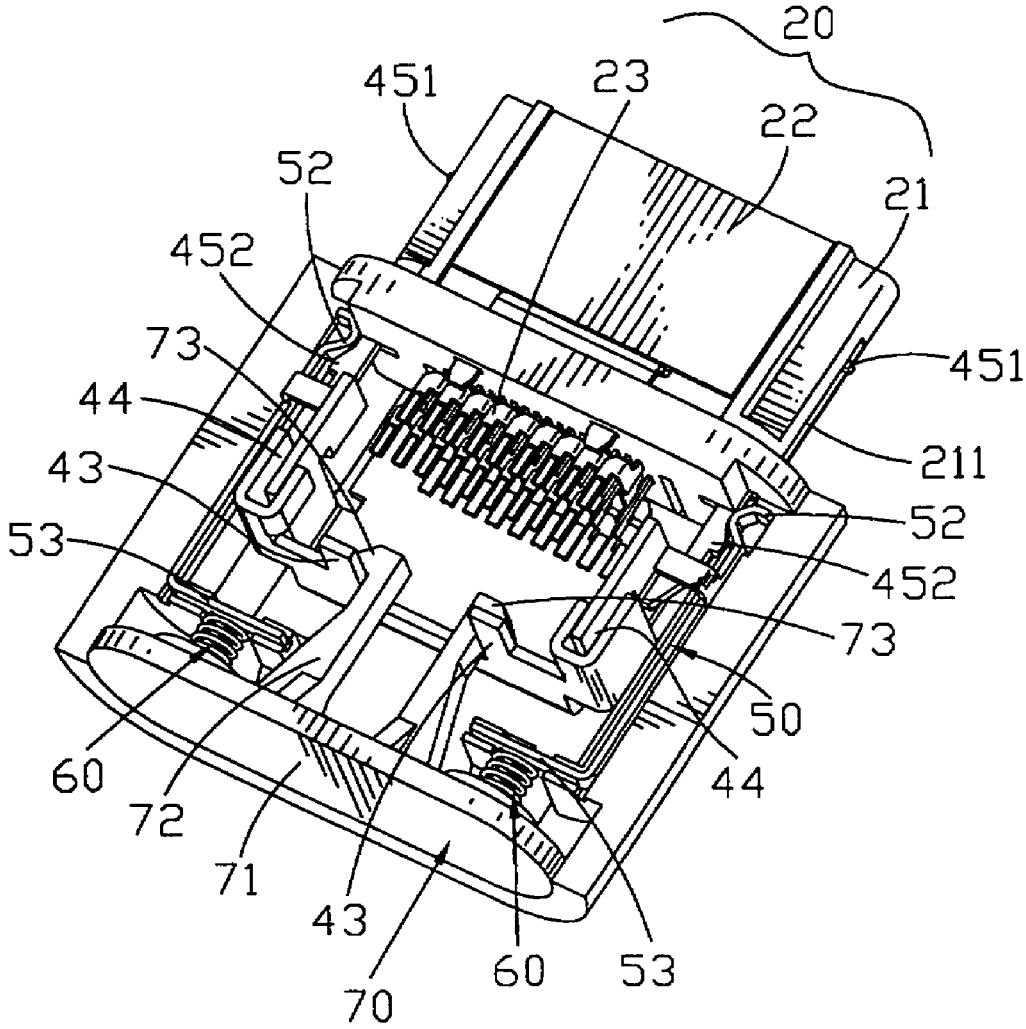
FIG. 3 is a perspective view of the first embodiment of a mating portion and the latch means assembled in a lower case.

Referring to FIG. 2 and FIG. 3, firstly, the lock arms 45 of the lock member 40 are inserted into the inlay cavities 211 from the back of the mating portion with the pawls 451 protruding from the inlay cavities 211. Then the mating portion 20 is arranged at the front of the lower case 12. The receiving member 70 is arranged in the back of the receiving space with the retaining projection 73 retained by the back board 43 beside the notch 431.

Figure 4:
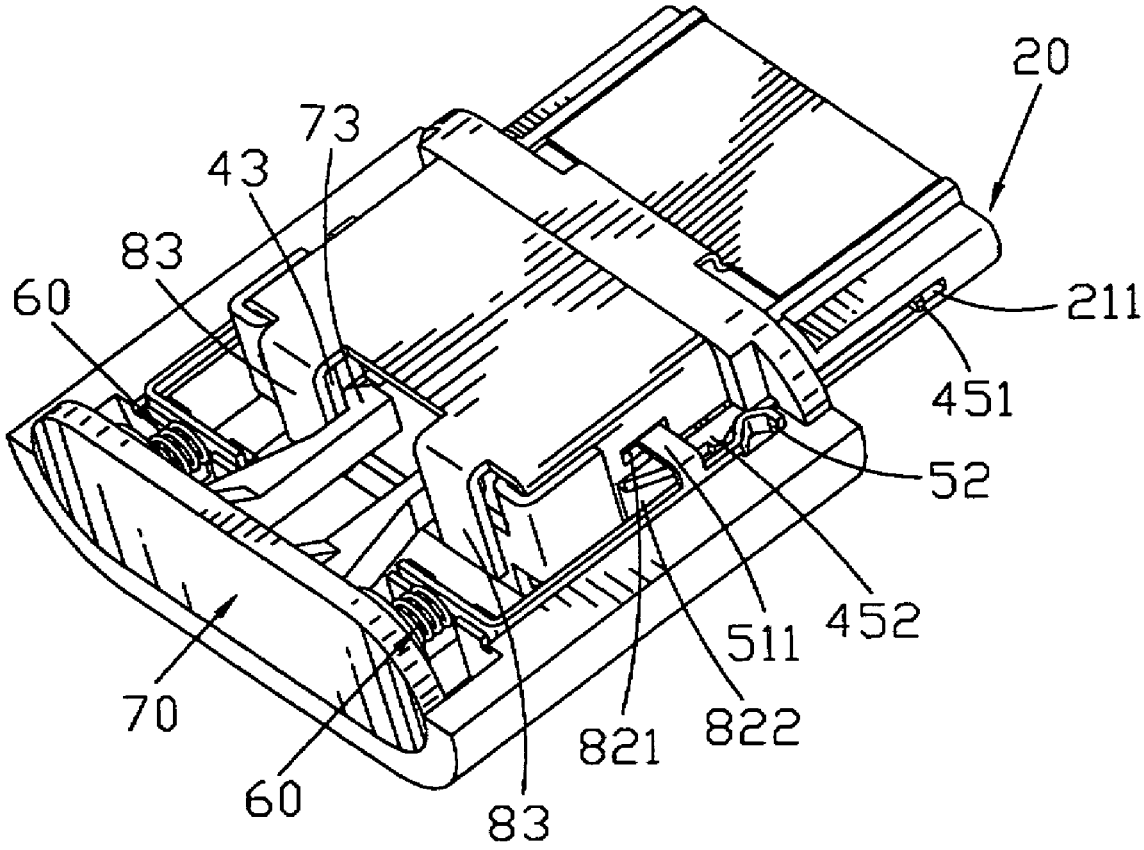
FIG. 4 is a perspective view of the first embodiment of the mating portion, the latch means and a shield assembled in the lower case.

Referring to FIG. 1 and FIG. 4, the side plates 82 of the shield 80 are inserted into the retaining cavities 44 of the lock member 40, the back plate 83 contacts and cooperates with the back board 43, the projection 452 of the lock member 40 projects from the opening 822 of the shield 80. The press member 50 is received in the receiving cavity 123 of the lower case 12, the blocking portion 53 is received in the blocking cavity 128 with the end held in the holding cavity 125, the restricting piece 511 stretches into the restricting hole 821, the press portion 52 presses the projection 452 of the lock arm 45. The spring 60 is disposed between the blocking portion 53 of the press member 50 and the receiving board 71 of the receiving member 70. Finally, the upper case 11 engages with the lower case 12, thereby, the plug connector with latch means is assembled.

Please refer to FIGS. 3-4, in use, the mating portion 20 is inserted into the mating connector (not shown), the pawl 451 of the lock arm 45 cooperates with the mating connector. To disengage the plug connector 1 from the mating connector, the casing 10 is pulled, the lock member 40 stays still as the pawl 451 is locked by the mating connector; the press member 50 positioned in the lower case 12 moves backward along with the casing 10, the press portion 52 presses the projection 452 of the lock member 40 and drives the projection 452 move inward, as a result, the pawl 451 is driven to move into the inlay cavity 211, thereby, the plug connector with latch means 1 disengages from the mating connector easily.

When the press member 50 moves backward along with the casing 10, as the retaining projections 73 of the receiving board 70 are retained by the back board 43 of the lock member 40 and the lock member 40 stays still, the receiving board 70 also stays still. The blocking portion 53 of the press member 50 moves backward and compresses the spring 60 disposed between the blocking portion 53 and the receiving board 70. After the plug connector 1 is disengaged from the mating connector, the pawls 451 lost the cooperation with the mating connector, so the spring 60 recovers and presses the blocking portion 53 of the press member 50 and the receiving board 71 of the receiving member 70, then the press member 50 drives the casing 10 moves forward while the receiving member 70 drives the lock member 40 moves backward. The press portion 52 moves forward along the inclined side surface of the projection 452 until the press portion 52 arrives at the foot of the projection 452, then the press portion 52 and the projection 452 both return to nature, the pawl 451 of the lock member 40 projects from the inlay cavity 211. Thereby, the plug connector 1 returns to the state that the plug connector 1 is not inserted into the mating connector.

Figure 5:
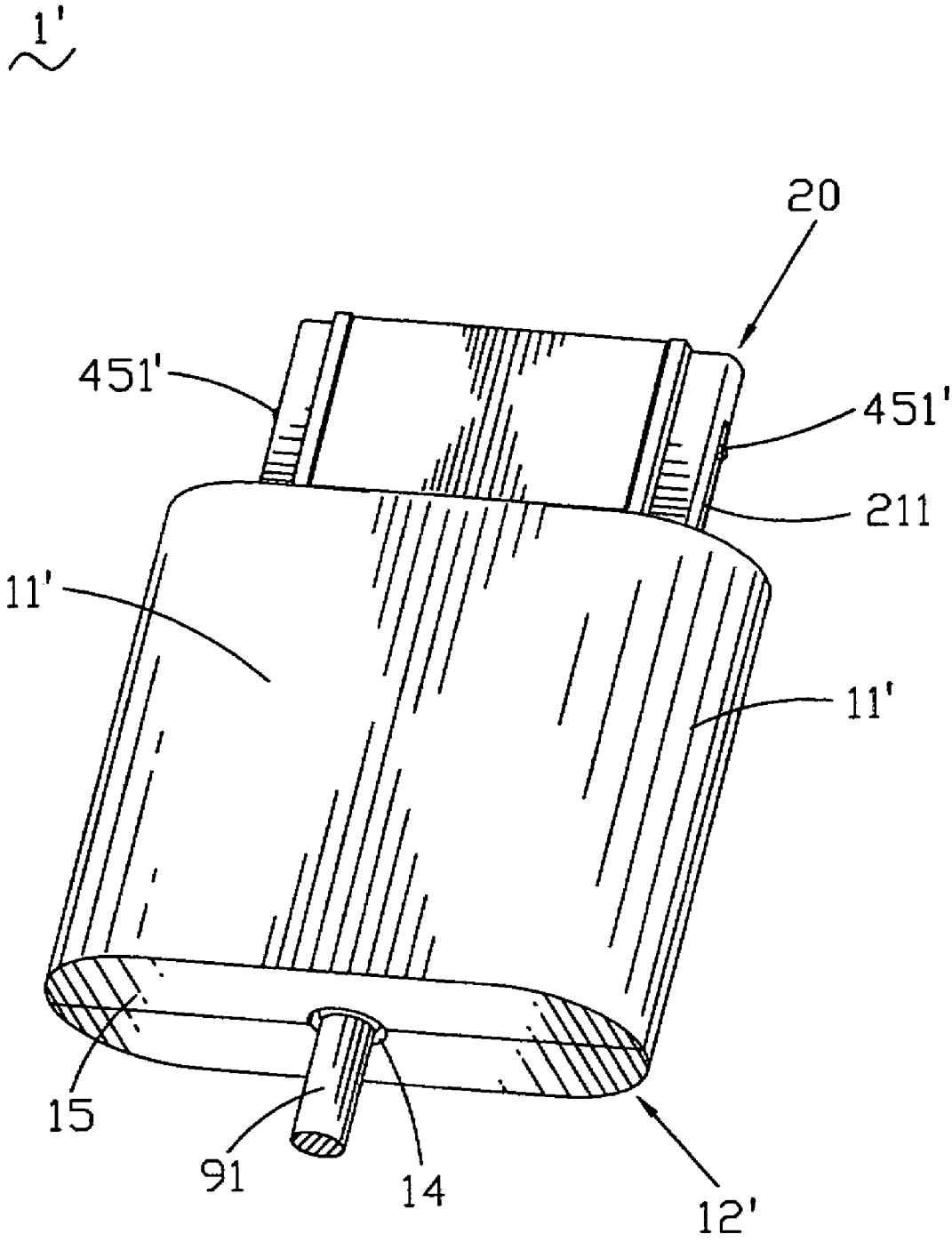
FIG. 5 is a perspective view of a second embodiment of the plug connector with latch means.
Figure 6:
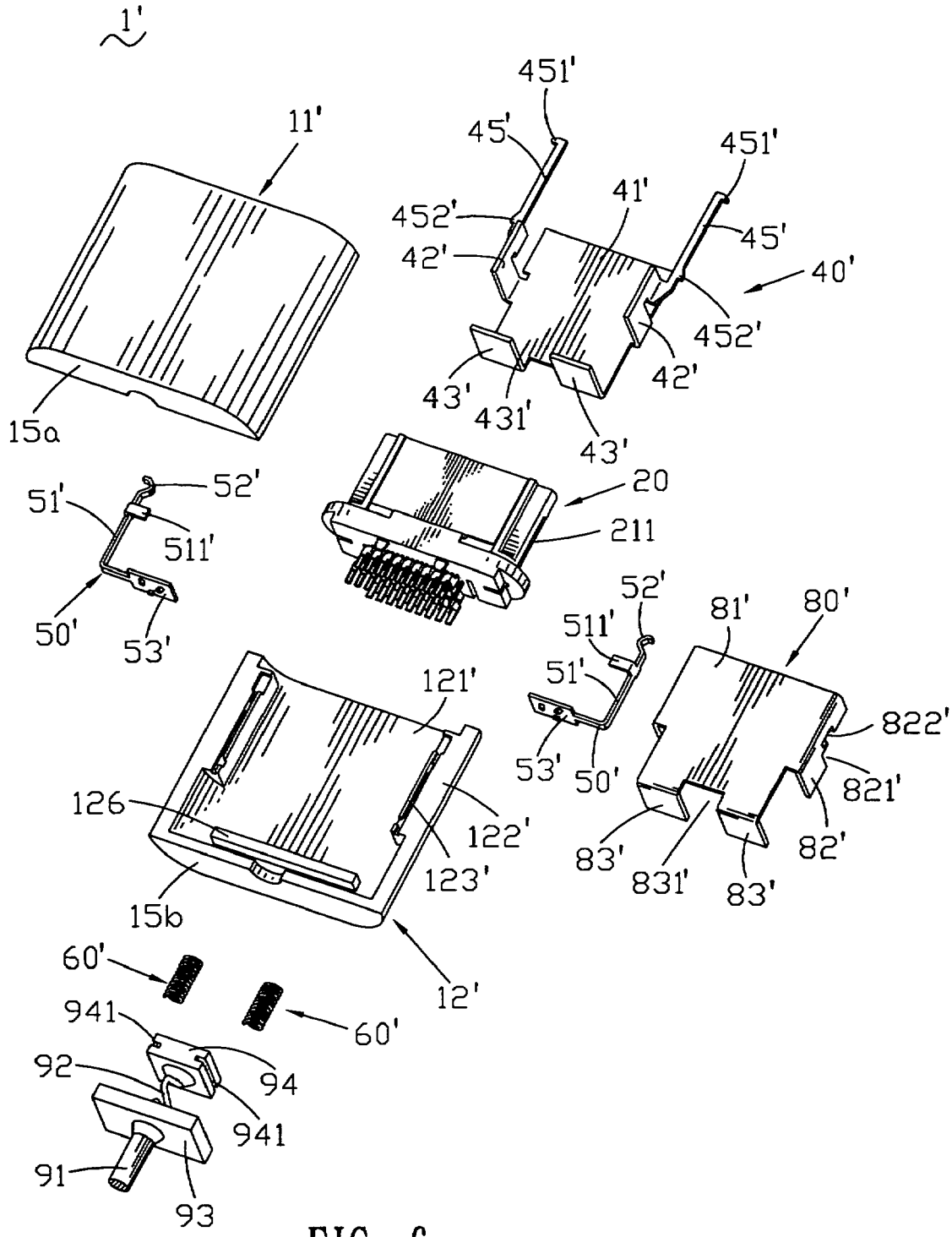
FIG. 6 is an exploded view of the plug connector with latch means shown in FIG. 5.
Figure 7:
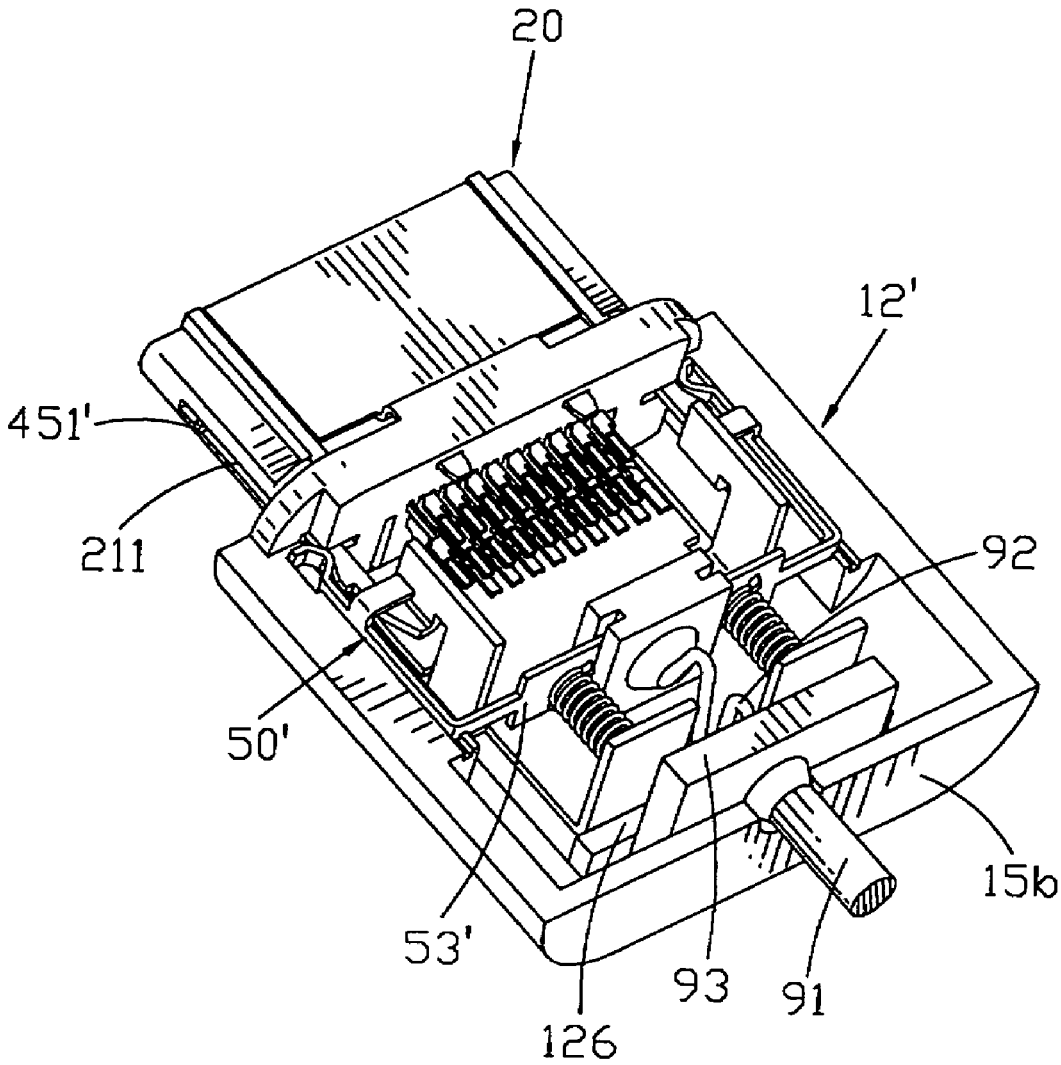
FIG. 7 is a perspective view of the second embodiment of the mating portion and the latch means assembled in a lower case.

FIGS. 5-7 show a second embodiment of the present invention. There are some differences between the first embodiment and the second embodiment. The casing 10' further includes a back wall 15, the upper case 11' includes an upper back wall 15*a* and the lower case 12' includes a lower back wall 15*b*. A rear hole 14 is disposed in the back wall 15. A blocking board 126 is mounted on the bottom wall 121' of the lower case 12', a receiving room is formed between the blocking board 126 and the lower back wall 15*b*. The back end of the lock member 40' extends upward and defines a back board 43' with a notch 431' in the center. The lock member 40' engages with the mating portion 20 and is arranged at the front of the lower case 12', the lock arm 45' is inserted into the inlay cavity 211, the pawl 451 projects from the inlay cavity 211, the projection 452' is exposed at the back end of the mating portion 20. The connecting arm 51' of the press member 50' is received in the receiving cavity 123' and the blocking portion 53' projects inward from the back end of the receiving cavity 123. The spring 60 is positioned between the back board 43' and the blocking portion 53'. An exterior cable 91 is positioned in the mating projection 93 and electrically connected to one end of a connecting cable 92, the other end of the connecting cable 92 is connected to an adapter 94. An inserting cavity 941 is disposed in each of two sides of the adapter 94, the end of the blocking portion 53' of the press member 50' is held in the inserting cavity 941, the mating projection 93 is arranged between the lower back wall 15*b* and the blocking board 126.

To disengage the plug connector 1 from the mating connector, the exterior cable 91 is pulled and drives the mating projection 93 press the lower back wall 15*b*, then the casing 10' moves backward and drives the press member 50' move backward, the press portion 52' presses the projection 452' of the lock member 40' and drives the projection 452' move inward, as a result, the pawl 451' is driven to move into the inlay cavity 211 and loses the cooperation with the mating connector, thereby, the plug connector with latch means 1 disengages from the mating connector easily. After that, the principle of the action in the second embodiment is similar to that in the first embodiment.

As described above, when the casing 10 or the exterior cable 91 connected to the casing 10' is pulled, the press member 50, 50' is driven to press the lock member 40, 40', so the pawl 451, 451' moves into the inlay cavity 211 and loses the cooperation with the mating connector, thereby, the plug connector with latch means 1 disengages from the mating connector easily. Compared to the prior art, the plug connector 1 of the present invention disengages from the mating connector only by pulling the casing 10 or the exterior cable 91, the operation is easy and convenient.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plug connector with latch means comprising:

a casing provided with two sidewalls, a receiving cavity being defined in each sidewall;

a mating portion received in the casing and the front portion of the mating portion projecting from the casing to the outside, having an insulated housing, each sides of the insulated housing defining an inlay cavity, the back end of the inlay cavity communicating with outside, and a plurality of contacts received in the mating portion; and a latch means having a lock member and a press member, the lock member defining a bottom board, a lock arm extended forward from the bottom board, a pawl projecting sideward from the front end of the lock, and a projection projecting sideward from the back end of the pawl, wherein the lock arm being inserted into the inlay cavity of the mating portion and the pawl projecting from the inlay cavity, the press member received in the casing, having a connecting arm, and a press portion formed at the front end of the connecting arm for pressing the projection, the press member being positioned in the receiving cavity, and wherein two opposite sides of the bottom board of the lock member extend upward to define two side boards, the back of the bottom board extends upward and defines a back board, the foot of each side board extends forward and forms a lock arm.

2. The plug connector with latch means as claimed in claim 1, wherein the casing comprising:

an upper case; and a lower case engaging with the upper case, a receiving space being formed therebetween, the lower case having a bottom wall and two sidewalls extending upward from two opposite sides of the bottom wall, wherein the mating portion is received in the front of the receiving space.

3. The plug connector with latch means as claimed in claim 2, wherein a blocking cavity is defined transversely at the back end of the receiving cavity and through the receiving space, a receiving projection is mounted on the bottom wall and corresponding to the blocking cavity, a holding cavity is defined in the receiving projection and keeps in one line with the blocking cavity, the back end bends inward to define a blocking portion received in the blocking cavity and the holding cavity of the receiving projection.

4. The plug connector with latch means as claimed in claim 3, further comprising a receiving member and a pair of spring, the receiving member comprising a receiving board and a pair of holding arm mounted on the receiving board, the front end of each holding arm projecting sideward and defining a retaining projection, wherein the back of the bottom board extends downward to define a back board, a notch is defined in the center of the back board, the retaining projection is retained by the back board beside the notch, and the spring is received between the receiving board and the press portion.

5. The plug connector with latch means as claimed in claim 2, further comprising a shield, the shield having a top plate, a back plate having a mating notch defined in the center, two side plates having a restricting hole, and an opening defined below the restricting hole, wherein the press member further comprises a restricting piece disposed on the lock arm and bends inward horizontally, the restricting piece stretches into the restricting hole.

6. The plug connector with latch means as claimed in claim 5, wherein two sides of the back board extend sideward and then bend forward to define two retaining cavities, the side plate of the shield is retained in the retaining cavity.

7. A plug connector with latch means comprising:

a casing provided with two sidewalls and a back wall having an upper back wall and a lower back wall, a mating notch being defined in the back wall, a receiving cavity being defined in each sidewall, the casing comprising an upper case, and a lower case engaging with the upper case, a receiving space being formed there-between, the lower case having a bottom wall having a blocking board mounted on, and two sidewalls extending upward from two opposite sides of the bottom wall, wherein the back end of the receiving cavity of the casing passes through the receiving space of the plug connector, a mating portion received in the casing and the front portion of the mating portion projecting from the casing to the outside, having an insulated housing, each sides of the insulated housing defining an inlay cavity, the back end of the inlay cavity communicating with outside, and a plurality of contacts received in the mating portion, wherein the mating portion is received in the front of the receiving space of the casing, and a latch means having a lock member and a press member, the lock member defining a bottom board, a lock arm extended forward from the bottom board, a pawl projecting sideward from the front end of the lock, and a projection projecting sideward from the back end of the pawl, wherein the lock arm being inserted into the inlay cavity of the mating portion and the pawl projecting from the inlay cavity, the press member received in the casing, having a connecting arm, and a press portion formed at the front end of the connecting arm for pressing the projection, the press member being positioned in the receiving cavity, the back end of the press portion bending inward to define a blocking portion, the press portion projecting from the back end of the receiving cavity.

8. The plug connector with latch means as claimed in claim 7, further comprising a mating projection and a pair of spring, an exterior cable connected to the mating projection, the mating projection is arranged between the blocking board and the lower back wall, the spring is received between the press portion of the press member and the back board of the lock member, the exterior cable projects from the casing through the mating notch.

9. The plug connector with latch means as claimed in claim 8, further comprises an adapter and a connecting cable, one end of the connecting cable is connected to the mating projection and the other end is connected to the adapter, each of the two sides of the adapter defines an inserting cavity for holding the end of the blocking portion of the press member.

* * * * *